United States Patent [19]

Davis

[11] Patent Number: 4,882,806

[45] Date of Patent: Nov. 28, 1989

[54] COUNTERBALANCING TORSION SPRING MECHANISM FOR DEVICES WHICH MOVE UP AND DOWN AND METHOD OF SETTING THE TORSION SPRINGS THEREOF

[76] Inventor: Thomas J. Davis, 629 Clifton Dr., NE., Warren, Ohio 44484

[21] Appl. No.: 217,321

[22] Filed: Jul. 11, 1988

[51] Int. Cl.[4] ..... E05D 15/16

[52] U.S. Cl. ..... 16/198; 16/196; 16/201; 16/1 C; 49/199; 49/200; 160/191; 160/201

[58] Field of Search ..... 16/196, 198, 199, 200, 16/201, 1 C, 289, 306, DIG. 1; 49/200, 199; 160/189, 191, 192, 201; 185/39

[56] References Cited

U.S. PATENT DOCUMENTS

| | | | |
|---|---|---|---|
| 2,083,467 | 6/1937 | Morris | 20/20 |
| 2,630,597 | 3/1953 | Robinson | 16/198 |
| 2,786,231 | 3/1957 | Robinson | 160/191 |
| 2,841,724 | 7/1958 | Brown | 310/76 |
| 3,311,159 | 3/1967 | Stansberry | 160/189 |
| 3,412,423 | 11/1968 | Binns | 16/198 |
| 3,615,065 | 10/1971 | Elliott | 160/191 |
| 3,635,277 | 1/1972 | Bahnsen | 160/191 |
| 3,685,567 | 8/1972 | Pemberton et al. | 160/8 |
| 3,921,761 | 11/1975 | Votroubek et al. | 185/39 |
| 4,731,905 | 3/1988 | Milano | 16/DIG. 1 |

*Primary Examiner*—Richard K. Seidel

*Assistant Examiner*—Edward A. Brown

*Attorney, Agent, or Firm*—Robert R. Hussey, II

[57] ABSTRACT

Counterbalancing mechanism for a garage door or other device in which a torsion spring end member is fastened to a second member to which it is connected during normal operation of the counterbalance by cooperating interfitting elements on the members which allow longitudinal movement of the end of the spring during a spring adjusting operation. The counterbalance hardware includes a self-locking winding mechanism for winding or unwinding one or more torsion springs which operates to fix one end of the spring connected thereto against movement during normal operation of the counterbalance. The structure connecting the ends of each torsion spring into the hardware is such that each end of the spring is always connected for rotation with either the torsion shaft of the counterbalance or the self-locking mechanism including during the adjustment or setting of the torsion in the springs. The mechanism is used in a novel method of setting or adjusting torsion spring tension in which the door is initially in a down position with the door unlocked and springs unwound. The springs are then wound to initially partly fit the door and then unwound to seat the door to establish the proper tension in the springs. Two springs are connected to the winding mechanism and are adjusted simultaneously.

36 Claims, 3 Drawing Sheets

COUNTERBALANCING TORSION SPRING MECHANISM FOR DEVICES WHICH MOVE UP AND DOWN AND METHOD OF SETTING THE TORSION SPRINGS THEREOF

This invention relates to a counterbalancing mechanism for counterbalancing the up and down movement of a garage door or other movable device, and more particularly to a torsion spring counterbalancing mechanism for use with garage doors and other devices, and to a method of adjusting and setting the torsion forces in the torsion springs of a garage door mechanism.

Conventionally, torsion spring counterbalancing mechanisms have been used in conjunction with overhead garage doors and other devices to counterbalance the weight of the door or device as it is moved between up and down positions. On installation of a torsion spring counterbalancing mechanism, it is necessary to wind the springs of the mechanism to establish the proper counterbalancing force in the spring. Also, after installation it is necessary to wind or unwind the springs after installation to effect adjustment of the setting of the torsion springs or to enable repairs to be made.

Garage doors are frequently counterbalanced with torsion springs. In a typical double spring door counterbalancing mechanism for a garage door, two torsion springs are disposed about a torsion shaft having cable reels mounted on its ends and cables which are connected from the reels to the bottom of the door adjacent the opposite side edges. The torsion shaft is rotated in opposite directions with movement of the door between its up and down positions. Normally the torsion shaft and springs are mounted on the doorway structure above the doorway and have a non-movable, i.e., fixed, support located centrally of the torsion rod. The inner ends of the torsion springs are connected by end members, e.g., cones, to the non-movable support to hold the inner ends of springs against rotation and movement along the torsion shaft and the outer ends of the springs are releasably connected through end cones or otherwise to the torsion shaft so as to be fixed against relative movement with respect to the torsion shaft. Conventionally, set screws are used to fix end cones to the torsion shaft and the other end cones are bolted to a fixed part of the stationary support.

During installation, the torsion springs must be wound to provide the proper counterbalancing torsional forces in the springs. The springs are also unwound and wound when repairs are to be made to the door assembly or counterbalancing mechanism or to adjust the setting of the counterbalancing forces of the torsion spring.

To wind or unwind a torsion spring in the typical conventional system, the end of the spring connected to the torsion rod is freed for rotation and movement along the torsion shaft and is then twisted around the shaft to wind or unwind the spring. This winding or unwinding is conventionally done by hand with the use of lever bars which are inserted into openings in a spring end member or cone which has been freed to rotate on the torsion shaft.

When working on a wound spring, the lever bar or other tool must be used to hold the spring end member or cone before it is freed for rotation to avoid a dangerous and violent unwinding of the spring. During winding or unwinding, the lever bar is often removed and inserted into the end cone or member at another position to continue the winding or unwinding of the spring. When winding or unwinding it is necessary to use a separate tool to prevent the spring from unwinding violently while the lever bar is being repositioned. It is also necessary to use the lever bar or other tool when the spring winding has been completed to hold the end cone or member until it is again fixed to the torsion shaft. As is well appreciated by those installing, adjusting, repairing, or disconnecting torsion counterbalancing mechanisms, the winding and the unwinding of a torsion spring in the conventional manner is a dangerous operation because of the spring forces involved and the fact that one end of the spring being adjusted is freed from its connection to the hardware.

Moreover, in all arrangements known to applicant in which the torsion spring forces are to be set on installation, each torsion spring must be wound separately. This requires multiple winding operations as well as making it difficult to balance the springs in multi-spring configurations.

U.S. Pat. No. 3,921,761 to Votroubek et al recognizes the danger involved in winding and unwinding a garage door torsion spring and attempts to address this problem. Votroubek utilizes a tool with a self locking worm drive gear and worm wheel which can be put into place about the torsion shaft to effect a gripping of an end collar for connecting the spring to the torsion shaft. After the collar is gripped, the end collar is released from the shaft for movement along and rotation about the torsion shaft. In Votroubek, the tool is mounted on the torsion shaft and blocked against rotation about the torsion shaft in a manner to allow the tool to move axially of the torsion shaft, as the spring is wound, to accommodate the growth of the spring during winding. In a double spring configuration using the Votroubek tool, the springs would be wound and unwound separately with the tool being used to wind the outer end of each spring.

While Votroubek's tool lessens danger, as compared to the conventional use of a lever bar for winding or unwinding a spring, the spring end is still held by a tool which is separate from the hardware of the mechanism and which must be assembled and disassembled to the counterbalancing mechanism for each winding or unwinding or adjustment of a torsion spring. This tool also must be securely blocked against rotation as a whole about the axis of the torsion rod each time a spring end is to be wound or unwound. Further, during the use of the tool, as in the case of using a lever bar, the door being counterbalanced is placed in a locked position until the winding operation has been completed and the freed end cones or members of the spring are resecured to the torsion shaft. With the door locked the setting of the proper spring forces in the torsion spring or springs is done with the use of charts and spring characteristic specifications. When working in this manner, it is difficult to achieve the proper counterbalancing forces, as is true of all the present conventional methods known to applicant, for setting the torsion in a torsion counterbalancing mechanism for a garage door.

It is the object of the present invention to eliminate the dangers of prior art mechanisms relating to torsion spring counterbalancing hardware and to simplify the installation and maintenance with an accompanying savings in time and labor and to improve the system performance and provide an extended life for the parts of the hardware.

It is further an object of the present invention to provide a torsion spring counterbalancing mechanism for a device, particularly a garage door, in which the torsion springs can be readily wound or unwound and proper torsion forces easily set while minimizing the inherent danger normally involved in winding or unwinding torsion springs and to provide a method of winding, unwinding and setting such springs for accomplishing this.

It is a further object of the present invention to provide permanently mounted torsion spring counterbalancing hardware which removes the dangers of the prior art and simplifies installation and maintenance and to provide such a mechanism for overhead doors which allows the spring adjustment for the door to be made with the door in a down position and unlocked.

Another object of the present invention is to provide adjusting and winding mechanism as described as a part of the counterbalancing hardware with the winding and adjusting mechanism being constructed in such a manner that it is not necessary to free the end of a spring from the counterbalancing hardware in order to effect a winding or unwinding of the spring for adjustment purposes and to provide such a counterbalancing hardware in a double spring arrangement for an overhead door so that both springs can be adjusted and wound simultaneously.

Still another object of the present invention is to provide a torsion spring counterbalancing mechanism for a door in which the connection of a torsion spring to a torsion shaft or a fixed support is setable to secure rotation thereof as a unit while permitting relative longitudinal movement of the torsion spring end and the part to which it is connected for rotation.

SUMMARY OF INVENTION

In accordance with the preferred embodiment of the present invention, a torsion spring counterbalancing mechanism for a door or other device, particularly a closure such as a garage door, includes, as part of the mechanism, a self-locking winding and adjusting mechanism for winding one or more torsion springs while maintaining both ends of each spring fixed against uncontrolled rotation by the spring forces. Each spring is connected to the self-locking winding and adjusting mechanism and to the torsion shaft with the connection for one end of each spring being setable to release the one end of the spring for longitudinal movement along the axis of the torsion shaft while holding the spring end against rotation separately of the part to which it is connected. To adjust, wind or unwind the spring, the adjusting mechanism is operable to rotate the spring end connected to it about the torsion shaft axis and to lock itself in a non-rotatable position to hold the torsional spring forces when the rotation of the spring end to wind or unwind the spring is stopped.

In a double torsion spring arrangement, the self-locking winding and adjusting means, in accordance with one aspect of the invention, is located between the springs of the torsion mechanism with the drive of the self-locking winding and adjusting mechanism rotating a drive shaft disposed about the torsion rod to simultaneously wind or unwind the normally fixed ends of the two springs with the connecting means for the springs for connecting the spring end to the torsion shaft and to the adjusting drive shaft being setable to allow relative movement of at least one end of each spring along the torsion shaft while the springs are being wound or unwound, but always with the springs being connected to a respective one of the torsion shaft and winding and adjusting mechanism for rotational movement therewith.

The present invention further provides a new method of winding springs in a torsion spring counterbalancing mechanism for a garage door, comprising the steps of using a self-locking winding mechanism for winding the fixed end of the torsion spring with adjusting and winding mechanism, starting the winding of the springs with the door in its down position requiring the greatest counterbalancing force and with each torsion spring to be wound having a spring end connected to the torsion shaft for rotation therewith, continuing the winding until the device is lifted a short distance from its down position, preferably about the equivalent of a quarter of a turn of the torsion springs, and allowing a spring end of each spring being wound to move along the axis of the torsion shaft during the winding operation, and then operating the winding and adjusting mechanism to unwind the spring means with both spring ends set against axial movement relative to the torsion shaft until the door of the device seats in its down position.

Spring counterbalancing mechanisms in accordance with the preferred embodiment of the present invention, preferably have worm wheels disposed about the torsion shafts of the mechanisms, the worm wheels being driven by worm gears to wind or unwind the normally fixed ends of the torsion springs used in the counterbalancing mechanisms with the worm gears rotating the worm wheels to rotate drive shafts to rotate or twist the normally fixed ends of the torsion springs to wind or unwind the torsion springs, the worm drive gears and worm wheels functioning to lock the fixed end of wound torsion springs from unwinding. In the preferred structure, the fixed ends of each torsion spring are connected to a worm wheel shaft by a connection which allows the end of the torsion spring to lengthen as it is wound with the connection being such that after the winding of the springs, the fixed end of the spring is setable to secure it against movement along the axis of the torsion shaft.

In the preferred practice for garage door counterbalancing, a double torsion spring arrangement is used and a worm wheel, drivable by a worm gear, has its drive shaft connected to and prevents rotation or longitudinal movement of the fixed ends of the springs, the worm wheel being drivable by the worm gear to rotate the drive shaft and the spring ends connected thereto for winding or unwinding both springs simultaneously, the worm gear and worm wheel being self locking on cessation of the drive by the worm gear to preclude the spring ends connected thereto from moving about the axis of the torsion shaft.

The invention further provides a torsion spring counterbalancing mechanism for a garage door in which a spring end member fixed to one end of the spring is connected by securing means to another member with the securing means preferably including cooperating interfitting elements on each of the two members, with the securing means being setable to provide for longitudinal movement along the torsion spring axis between said members during winding of the torsion spring while maintaining said members connected for rotation as a unit.

A feature of the invention is the provision of a winding and adjusting mechanism for winding or unwinding a torsion spring as part of the counterbalancing hardware for a door, in which the end of the spring to which the adjusting mechanism is connected is allowed to move as the spring is wound or unwound and is constructed in such a manner that the end of the spring will be automatically held in a fixed position when the spring is not being adjusted.

Another feature of the invention is the provision of a winding and adjusting mechanism, as in the next preceding paragraph, in which the end of the spring is held in adjusted position by a worm gear and worm wheel mechanism.

Another feature of the present invention is that it is not necessary to disconnect the end of a spring from the counterbalancing hardware in order to effect a winding or unwinding of the spring for adjustment purposes. A further feature of the present invention is that in a double spring mechanism for an overhead door, both double springs can be wound at one time.

DESCRIPTION OF DRAWINGS

Referring to the drawings illustrating the preferred embodiment of the present invention, and forming a part of this present specification for all matters shown therein.

DESCRIPTION OF PREFERRED EMBODIMENTS

Figure 1:
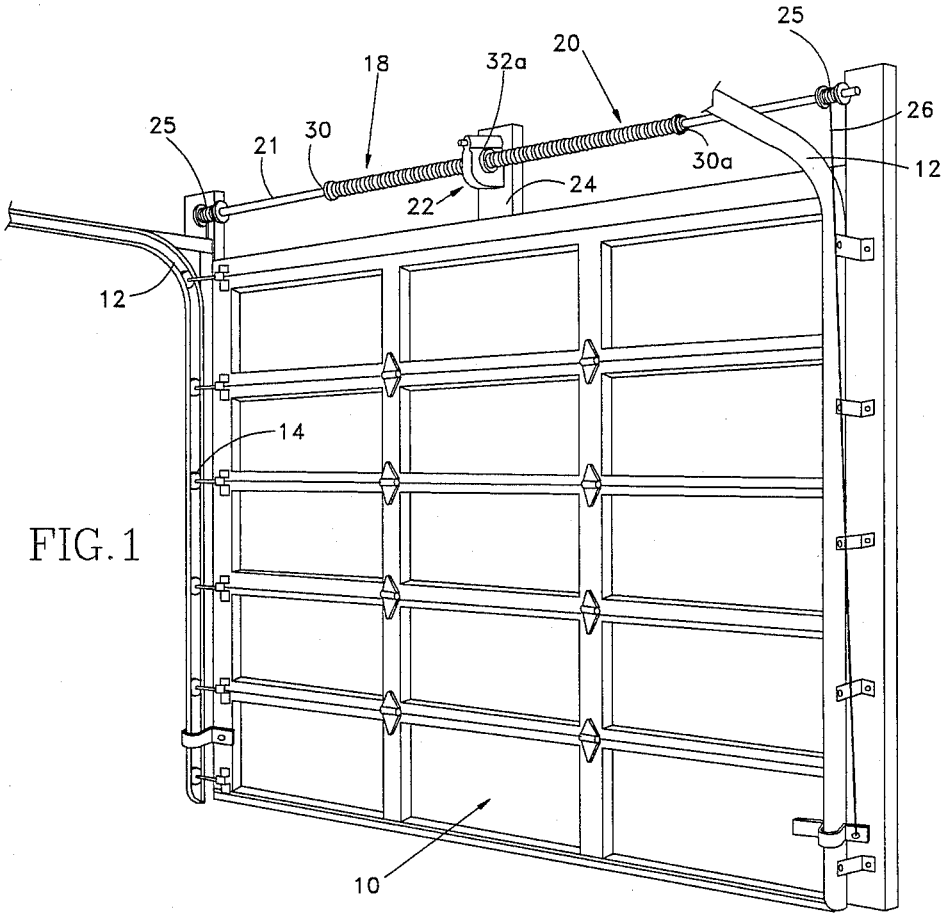
FIG. 1 is a fragmentary perspective view from the inside of a garage showing a folding garage door, door supporting structure, and door counterbalancing hardware embodying a winding and adjusting mechanism in accordance with the present invention.

In the drawings, the preferred form of the present invention is illustrated in a counterbalancing mechanism for an overhead garage door 10 supported for up and down movement between open and closed positions by the conventional guide and support channels 12 with the door having rollers 14 which are received in the guide channels. Counterbalancing mechanism embodying the present invention, is illustrated in FIG. 1 as being mounted on the garage door wall above the doorway. The illustrated mechanism embodies a conventional double torsion spring arrangement with torsion springs 18 and 20 which are disposed in coaxial alignment about a torsion shaft 21. The adjacent inner ends of the torsion springs 18 and 20 are connected to a winding and adjusting mechanism 22 located between the springs. The mechanism 22 is mounted on a support 24 and is fixed on the garage structure against movement about or axially of the torsion shaft 21.

The outer ends of the torsion springs 18, 20 are connected to the torsion shaft 21 which, in turn, has conventional cable reels 25 mounted at the opposite ends of the shaft, so that the reels and torsion shaft rotate as a unit when the door 10 moves up or down. The cable reels 25 wind and unwind cables 26 which are connected to the door 10 in a conventional manner that will not be described in detail. Suffice it to say that the cable reels 25 have cables 26 connected to the door 10 at the lower part of the door adjacent its side edges and when the door is moved downwardly, the cables wind off the reels and rotate the shaft 21. When the door 10 is moved upwardly, the torsion springs 18, 20 rotate the torsion shaft 21 and reels 25 and the cables 26 are wound onto the reel.

Figure 2:
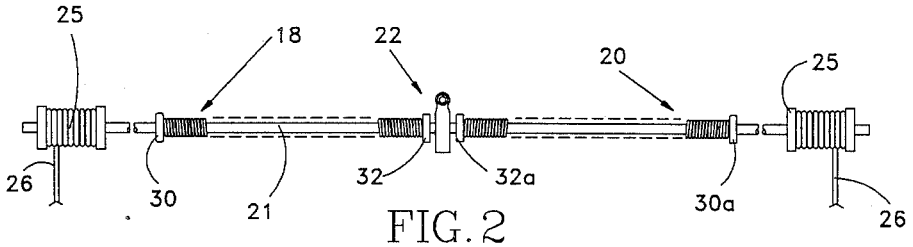
FIG. 2 is a front elevational view, of the door counterbalancing hardware of FIG. 1.
Figure 6:
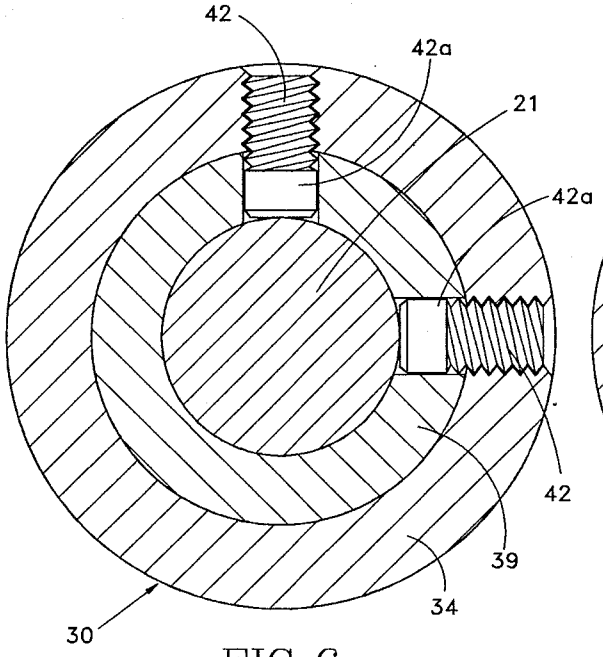
FIG. 6 is a vertical cross-sectional view taken along line 6—6 of FIG. 5.
Figure 5:
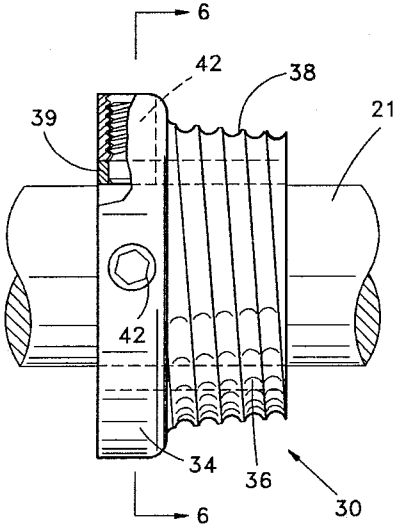
FIG. 5 is fragmentary view showing in elevation a spring connecting end cone and the torsion shaft of the counterbalancing hardware of FIG. 1, the torsion spring being omitted.

Referring to FIG. 2, the outer ends of the torsion springs 18, 20 are connected to the torsion shaft 21 by respective fastening means comprising end members or cones **30, 30*a*. The inner ends of springs 18 and 20 are connected to the self locking spring winding and adjusting means 22 by end members or cones 32, 32*a* which are substantially identical to the end cones 30, 30*a*. The end cones 32, 32*a* are disposed on and about an output drive shaft 50, shown in FIG. 3, of the winding and adjusting mechanism 22. The end cones 32, 32*a* for connecting the springs 18, 20 to the shaft 50 are substantially identical and each have a collar portion 34 and a tapered portion 36 which has a conventional right and left hand thread 38 on its outer periphery (See FIG.5). The cones 32, 32*a* are threaded into the inner ends of the springs 18 and 20 in a conventional manner to fixedly secure the spring with the connecting cone. Each of the end cones 30, 30*a* are disposed about a bushing 39 on the torsion shaft 21, as illustrated in FIGS. 5 and 6. The end cone 30, bushing 39 and torsion shaft 21 are connected together in a fixed relationship against relative movement to each other by securing means comprising set screws 42 disposed 90° apart in the collar portion 34. The set screws 42 thread into radial openings in the collars 34 of the end cones 30, 30*a* and have unthreaded portions 42*a* which pass through aligned openings in the corresponding bushing 39 to engage the torsion shaft 21** to secure the torsion shaft, bushings and respective end members against movement relative to each other.

Set screws 42 have unthreaded leading end portions **42*a* so that the screws cannot back out or be backed out of the end cones 30, 30*a*. During assembly of the hardware for the counterbalancing, as on installation, the set screws 42 are threaded into the end collar 34 when it is disposed around the bushing 39 with the set screws being inserted from the inside of the bushing prior to the assembly of the end cone 30 and bushing 39 onto the shaft 21**.

Figure 4:
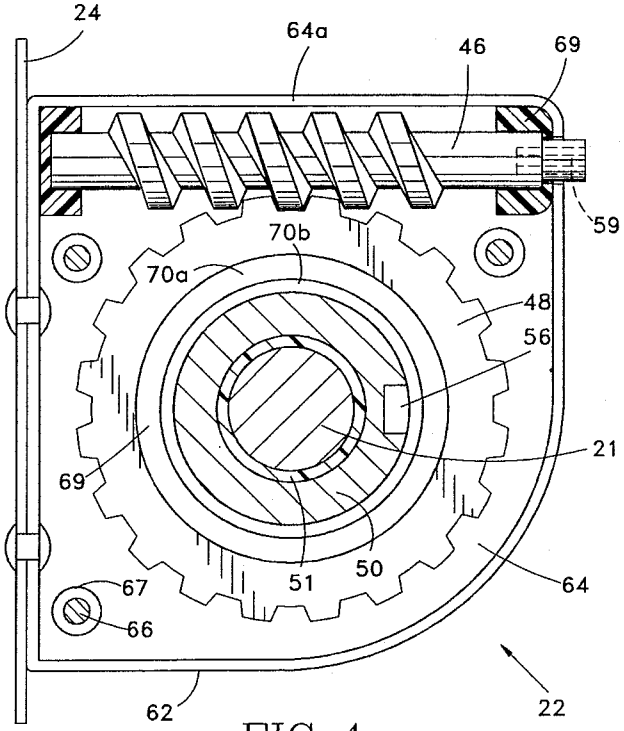
FIG. 4 is a vertical cross-sectional view of the winding and adjusting mechanism shown in FIG. 3 with the left hand walls of the winding and adjusting mechanism removed.
Figure 3:
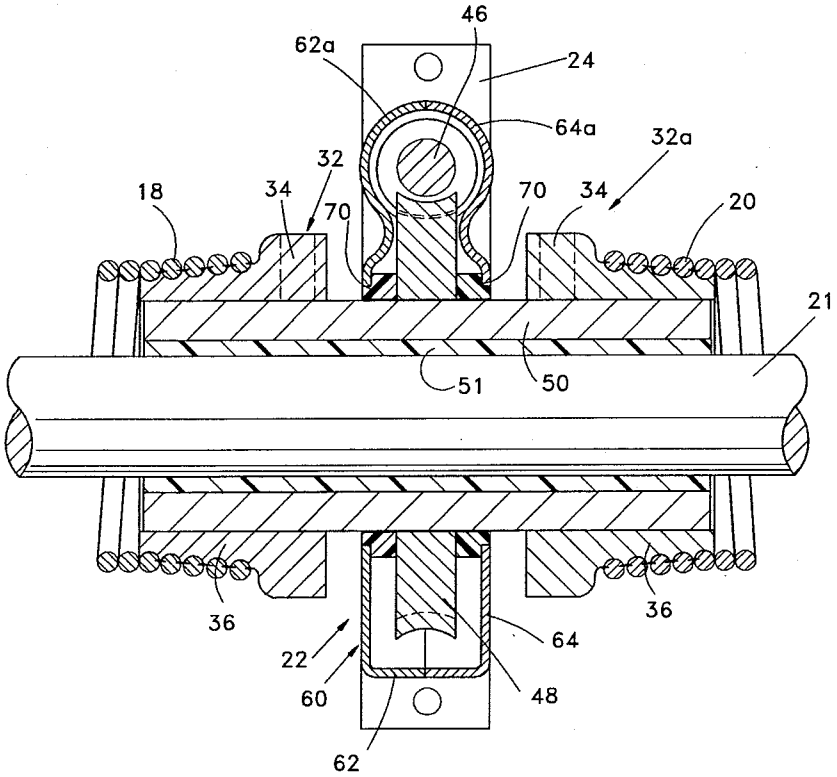
FIG. 3 is a vertical cross-sectional view of the winding and adjusting mechanism incorporated in the counterbalancing hardware of FIG. 1 taken along the horizontal center line of the winding and adjusting mechanism.

The end cones **32, 32*a* connecting the inner ends of springs 18 and 20, to the self locking spring winding and adjusting means 22 are disposed on and about an output drive shaft 50 of the winding and adjusting mechanism, as illustrated in FIGS. 2, 3, and 4**.

Figure 7:
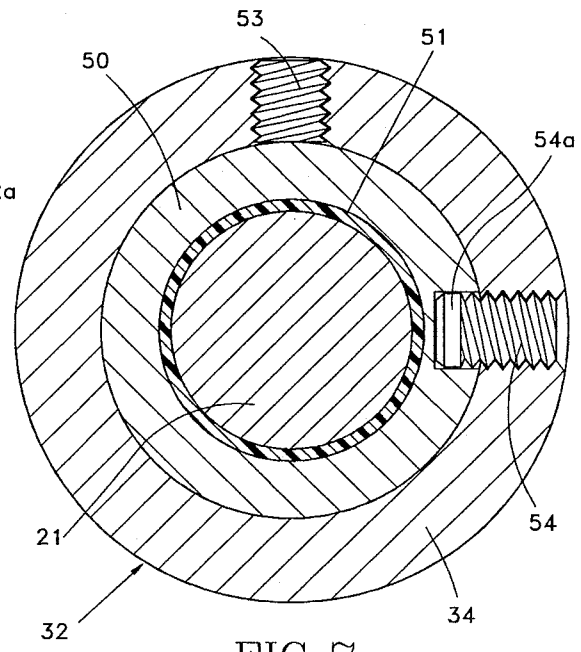
FIG. 7 is a vertical cross-sectional view taken through the right hand end cone shown in FIG. 3 to illustrate the connection of the end cone to the output shaft of the winding and adjusting mechanism.

The winding and adjusting mechanism 22, in the preferred and illustrated embodiment and as best illustrated in FIGS. 3 and 4, comprises a worm drive gear or pinion 46 which is rotatable to drive a worm wheel 48 keyed to the rotatable drive shaft 50, the latter being coaxial with and journaled on the torsion shaft 21 by a plastic nylon or neoprene, bearing 51. The drive shaft 50 extends laterally from the opposite sides of the gear wheel 48 and into the end cones 32, 32a, for the springs 18 and 20. The end cones 32, 32a of the springs 18 and 20 are connected to the drive shaft 50 by set screws 53, 54 (FIG. 7) disposed 90° apart in the collars 34 f the end cones. The set screws 53, 54 thread into openings in the collars 34 of the end cones 32, 32a to engage with the drive shaft 50. The set screws 54 extend into a receiving opening or slot, a keyway 56 in the preferred embodiment, in the output drive shaft 50. This keyway 56 may be the same keyway as used for keying the worm wheel 48 to the drive shaft 50. As in the case of set screw 42, preferably, the set screws 54 have an unthreaded leading portion 54a so that the set screw cannot back out of the keyway 56 in the drive shaft 50. It will be appreciated that when the set screws 53, 54 are set against the drive shaft 50, the end cones 32, 32a are held against movement relative to the drive shaft. If set screw 53 is backed off the shaft 50, the keying connection provided by set screw 54 and the keyway 56 of the drive shaft will prevent relative rotation of the end cone 32 and drive shaft but will allow relative axial movement along the shaft axis, provided the set screw 54 is also backed off the bottom of the keyway. When the set screws 53, 54 are set against the periphery of the shaft 50 and the bottom of the keyway 56 for normal operation, the end cones 32, 32a are fixed to the drive shaft and are held in a fixed position. It will be noted that the worm wheel 48 and worm gear 46 cannot be driven by the torsional forces of a wound spring acting on the drive shaft 50 because of the self-locking effect of the worm wheel and worm gear with respect to a drive from the shaft to the worm wheel. Thus, the winding and adjusting mechanism 22 provides a fixed connection for the inner ends of springs 18 and 20 except as the worm drive gear 46 is itself being driven. To drive the worm drive gear 46, the shaft of the worm drive gear extends outwardly from the worm gear and has an allen type recess 59 in the end thereof for receiving a tool for rotating the worm gear to drive the end cones 32, 32a connected thereto and twist the inner ends of the springs 18 and 20 about the axis of the torsion shaft 21.

In the preferred and illustrated embodiment the worm wheel 48 and drive worm gear 46 are located in a housing 60 (FIG. 3) which may be a vertically split housing of two sections 62, 64 with each section forming one side of the housing and half of the front, back and bottom of the housing. The two sections 62, 64 may be bolted together with bolts 66 (FIG. 4) extending through both sides of the housing 60 and wall spacers 67 on the bolts for spacing the internal sides of the housing from each other. The back side of one of the two sections 62, 64 may be securely welded, screwed, bolted, or riveted to the support 24.

The tops of the sides 62, 64 of the housing may be formed, as illustrated in FIGS. 3 and 4, to provide curved sections 62a, 64a to provide journals for neoprene or nylon bearings 69 on the worm drive gear 46. The output drive shaft 50 from the worm wheel 48 which extends outwardly from the sides of the housing 60, is journaled in the housing by the nylon or neoprene bearings 70, which have flange portions 70a (FIG. 4) along the inside of the housing wall 60 to provide a thrust bearing for the worm wheel and axially extending portions 70b for journaling the hollow drive shaft 50 in the sides of the housing 62, 64.

When the counterbalancing mechanism is to be installed on a garage door 10, the hardware is assembled and, in the illustrated embodiment, is mounted above the doorway in a conventional manner with the adjusting mechanism 22 connected to a fixed support 24 on the inside wall of the garage above the doorway. The cables 26 are connected between the reel 25 and the door 10 with the door set in its down position. The set screws 42 in the outer end cones 30, 30a of the torsion springs 18, 20 are tightened to then connect the torsion spring to the torsion shaft 21. The set screws 53, 54 in the inner end cones 32, 32a for the inner ends of the torsion springs 18, 20 are not set against the output drive shaft 50 and, therefore, allow the end cones to move axially of the drive shaft along the keyway 56 as the spring is wound to accommodate growth of the spring. A suitable tool, preferably an allen type wrench or power driven allen type drive, is inserted into the drive socket 59 for the worm drive gear 46 to rotate the worm wheel 4 and drive shaft 50 in a direction to cause the winding of the spring. As the spring winds, the spring will grow and the end cones 32, 32a will move longitudinally of the torsion shaft 21 and the adjusting drive shaft 50. The spring is wound until the torsion in the spring causes the garage door to lift a small distance, e.g. 1–2 inches, which is normally about ¼ of a turn of the drive shaft 50. The torsion in the springs 18, 20 have now imposed the ideal setting. At this time, the set screws 53, 54 for preventing movement of the driven end cones 32, 32a along the drive shaft 50 or the torsion shaft 21 are set against the outer periphery of the drive shaft to preclude relative movement between the inner spring ends and their end cones relative to the torsion shaft. The drive to the worm drive gear 46 is then reversed and the springs 18, 20 unwound until the door 10 is in its proper closed position. At this time the torsion in the torsion springs 18, 20 should be slightly less than that necessary to fully counterbalance the weight of the door 10 to provide a firm seating of the door but yet the forces are sufficient to provide for easy raising of the door with the help of the counterbalance.

With the set screws 42, 53, 54 set to preclude movement of all the end cones 30, 30a, 32, 32a, respectively, along the torsion shaft 21, the operation of the winding and adjusting mechanism 22 to lower the door 10 causes the coils of the springs 18, 20 to separate from each other since the length of the springs cannot now shorten as the spring is unwound to seat the door in its closed position, e.g. for about ¼ of a turn. The separation of the coils of the springs 18, 20 reduces friction which would otherwise exist in the springs as in the conventional prior art.

In this method of installation, both of the springs 18, 20, in a double spring arrangement of the type illustrated in the drawings, are wound at the same time. The described method of initially setting the proper torsion in the springs 18, 20 also eliminates the need for using charts and spring characteristics as a guide to winding the springs as well as eliminating the danger heretofore connected with winding, unwinding, or adjusting the springs because the end members or cones 30, 30a, 32, 32a of the springs being adjusted were free to rotate relative to the torsion shaft 21 during any winding or unwinding of a spring for purposes of setting, adjusting, or unwinding the springs.

It will be understood that the present invention may be incorporated in various types of torsion spring counterbalances for garage doors, or for other devices to be moved up and down between two positions, and that the invention is applicable to torsion spring counterbalancing systems using a single torsion spring or multiple torsion springs. Also, the longitudinal movement of a spring end during the winding of the torsion spring may be provided in the connection for the end member which connects one of the spring ends to the torsion shaft although the preferred embodiment incorporates such movement in the connection to a winding and adjusting mechanism which fixes the spring end against movement during normal operation of the counterbalance.

What I claimed is:

1. A torsion spring counterbalancing mechanism for a garage door or other device to be moved up and down comprising a torsion shaft rotatable about an axis, torsion spring means comparison a torsion spring to be wound as the device moves down and unwound as it moves up disposed about said shaft, means connecting the torsion shaft with said device to rotate the shaft in a direction to wind the spring as the device moves down and for rotation in the opposite direction as the device moves up, a respective end member connected to each end of the torsion spring, torsion spring winding and adjusting means comprising a support structure mounted against movement about or along the axis of said torsion shaft, said winding and adjusting means comprising an output drive shaft coaxial with and rotatable in said structure about said axis and self-locking drive means on said structure for rotating said drive shaft in different directions about said axis to respectively wind and unwind said torsion spring, end fixing means for said torsion spring means comprising first and second connecting means connecting a respective one of said end members to a respective associated one of said rotatable torsion and drive shafts to fix the corresponding end member against relative movement with respect to the respective rotatable shaft, one of said first and second connecting means comprising securing means for interchangeably fixing the respective end member for the connecting means to the associated shaft for rotation therewith while allowing longitudinal movement of the end member relative to its associated shaft during the winding of said spring by said winding and adjusting means or fixing the end member against movement longitudinally of its corresponding shaft and for rotation therewith for effecting the counterbalancing of said device.

2. A torsion spring counterbalancing mechanism for a garage door or other device movable between up and down positions as defined in claim 1 in which said securing means includes interfitting connecting elements on the respective end member and the associated shaft to which the securing means connects the end member with said interfitting connecting elements interfitting with each other and being selectively setable relative to each other to allow relative longitudinal movement along the associated shaft while precluding relative rotational movement of the associated shaft and end member or to fix said associated shaft and end member against rotation and relative longitudinal movement.

3. A torsion spring counterbalancing mechanism for a garage door or other device movable between up and down positions as defined in claim 1 wherein said winding and adjusting means comprises a worm wheel having a fixed position along said torsion shaft and rotatable about said torsion shaft for rotating said drive shaft, and a worm drive gear for said worm wheel for selectively rotating or the worm wheel, said worm drive gear and worm wheel precluding rotation of the drive shaft and worm wheel by the spring connected thereto.

4. A torsion spring counterbalancing mechanism for a garage door or other device movable between up and down positions as defined in claim 3 in which said securing means includes interfitting connecting elements on the end member and on the shaft to which the securing means connects the end member with said interfitting connecting elements being so constructed and arranged to allow relative longitudinal movement along the shaft while precluding relative rotational movement of the shaft and end member.

5. A torsion spring counterbalancing mechanism for a garage door or other device movable between up and down positions as defined in claim 1,2,3, or 4 wherein said second connecting means connects the corresponding end member to said drive shaft and comprises said securing means.

6. A torsion spring counterbalancing mechanism for a garage door or other device movable between up and down positions as defined in claim 1 wherein said torsion spring means comprises said first said spring as a first spring and a second torsion spring disposed coaxially about said torsion shaft and said winding and adjusting means being disposed between said springs, end members each connected to respective one of the opposite ends of said second spring, said end fixing means further comprising third and fourth connecting means each connecting a respective one of said end members for said second spring to a respective one of said rotatable torsion and drive shafts to fix the corresponding end member against relative movement with respect to the respective rotatable shaft, one of said third and fourth connecting means comprising securing means for interchangeably fixing the end member to its respective shaft for rotation therewith while enabling longitudinal movement of the end member relative to its respective shaft during the winding of said spring or fixing the end member against movement longitudinally of its corresponding shaft and for rotation therewith.

7. A torsion spring counterbalancing mechanism for a garage door or other device movable between up and down positions as defined in claim 6 in which each said securing means includes interfitting connecting elements on the end member and on the shaft to which the securing means connects the end member with the interfitting connecting elements being constructed and arranged and selectively setable to allow relative longitudinal movement of the end member along the shaft while precluding relative rotational movement of the shaft and end member.

8. A torsion spring counterbalancing mechanism for a garage door or other device movable between up and down positions as defined in claim 6 wherein said drive means is disposed in a fixed position along the axis to the torsion shaft and comprises a worm wheel rotatable about said torsion shaft for rotating said drive shaft, and a worm drive gear for said worm wheel for selectively rotating or adjusting the worm wheel, said worm drive gear and worm wheel being self-locking to preclude rotation of the drive shaft and worm wheel by the springs connected thereto.

9. A torsion spring counterbalancing mechanism for a garage door or other device movable between up and down positions as defined in claim 8 in which each said securing means includes interfitting connecting elements on the end member and on the shaft to which the securing means connects the end member with said interfitting connecting elements of each securing means being so constructed and arranged to selectively allow relative longitudinal movement along the shaft while precluding relative rotational movement of the shaft and end member.

10. A torsion spring counterbalancing mechanism as defined in claim 6, 7, 8, or 9 wherein each connecting means connecting a spring end member to said drive shaft comprises said securing means and said inter-fitting elements.

11. In a garage door counterbalancing mechanism, counterbalancing means including torsion spring means comprising a torsion spring disposed about said axis a spring end member fixed on one end of said spring, a second member to which the said one end of the spring is fixedly connected when counterbalancing a garage door, connecting means for fixing said end member to said second member to preclude rotation of the spring end when counterbalancing a door which is moved up and down, said connecting means comprising securing means comprising interfitting elements cooperating to fix said end member to said second member to secure them against relative movement, said connecting means being selectably setable to a first condition for allowing relative longitudinal movement during spring winding between said end member and said second member longitudinally of the axis of said torsion spring while maintaining a mechanical connection therebetween for preventing relative rotation of said end member and said second member or to a second condition for fixing said end member and said second member against relative longitudinal and rotational movement, and means for rotating said second member to wind or unwind the spring.

12. In a garage door counterbalancing mechanism as defined in claim 11 in which said spring is disposed about a torsion shaft and said second member and said end member are disposed about said shaft, said mechanism further comprising driven means operatively connected to said second member for driving said second member to wind and unwind said spring, said first condition of said securing means during winding allowing longitudinal movement to accommodate the growth of the length of the spring during the winding and the setting of said connecting means and said second condition fixing the length of the spring and causing a separation of the spring coils during movement of the door to unwind the spring as the door is moved downwardly.

13. In a garage door counterbalancing mechanism as defined in claim 12 in which said shaft is a rotatable drive shaft for rotating said spring end about its axis and has drive means associated therewith to rotate said drive shaft to wind or unwind said spring.

14. In a garage door counterbalancing mechanism as defined in claim 11 in which said second member is a rotatable shaft and drive means is associated therewith for driving said second member to move said end of the torsion spring about the axis of the spring to wind or unwind the spring.

15. In a garage door counterbalancing mechanism as defined in claim 13, or 14 in which said drive means comprises a worm wheel connected to said drive shaft and a worm gear for driving said worm wheel to rotate said drive shaft with said worm gear and worm wheel being self-locking against being driven from said drive shaft and in which said torsion spring means comprises a second torsion spring disposed coaxially with the first said spring with said drive means being disposed between said torsion springs adjacent to an end of said second spring, a second spring end member fixed to said end of said second spring, an output drive shaft portion from said drive means to be connected to said second spring end member for rotating the end member to wind or unwind said spring, second securing means connecting said second spring end member to said shaft portion for rotation therewith and simultaneous rotation with said drive shaft and selectably settable to allow said second spring end member to move longitudinally of said shaft portion upon the rotation thereof during the winding of said spring while precluding relative rotation between said second spring end member and shaft portion.

16. A method of winding the torsion spring means in a torsion spring counterbalancing mechanism for a garage door, the mechanism comprising a torsion spring connected to a torsion shaft which is in turn connected to the door and supported for rotation in respective opposite directions as the door moves respectively in up and down between its positions, the steps of setting the door in its down position with the door and torsion shaft connected for rotation with door movement, connecting one end of the torsion spring to the torsion shaft so that the spring is wound by rotation of the shaft with downward movement of the door and unwound with upward movement of the door, the other end of the spring being connected to a drive member for moving the other end of the spring about its axis, rotating the said other end of the spring to wind the spring while permitting relative longitudinal movement of one spring end along the axis of the shaft relative to the said shaft or drive member to which it is connected during the winding of the spring while maintaining that end secured against rotation with respect to the shaft or drive member to which it is connected until the door is lifted a relatively short distance from its down position, then fixing the longitudinally movable spring end against longitudinal movement while using the drive member to hold the spring end connected thereto against rotation and then driving the spring end in a direction to unwind the spring with both ends of the spring fixed against movement relative to the respective said shaft or drive member to which it is connected until the door seats in its down position.

17. A method as defined in claim 16 in which said drive member is an output shaft of a driving mechanism which is used to fix the spring end against movement on the completing of a winding or unwinding operation and the longitudinal movement by the spring end during winding is provided by movement of the spring end connected to the drive member position and the fixing of the spring end connected to said output shaft against longitudinal movement the unwinding of the spring to set the spring torsion effects a separation of the coils of the spring coils.

18. A method as defined in claim 17 wherein the counterbalancing mechanism has two torsion springs disposed about the torsion shaft and the step of connecting the ends of the first-said torsion spring to the torsion shaft and the driving member includes connecting the ends of said second torsion spring respectively to the torsion shaft and an output shaft from the drive mechanism so that the second spring is wound simultaneously with the first-said spring and during the winding of the said springs allowing the end of said second spring connected to the output shaft to move longitudinally relative to the output shaft while being rotated thereby during the winding of the spring and then fixing that end against longitudinal movement when so fixing the end of the first-said spring and then unwinding both springs simultaneously to set the door in its down position.

19. A torsion spring counterbalancing mechanism for a garage door or other device to be moved up and down comprising a torsion shaft rotatable about an axis, torsion spring means comprising a torsion spring to be wound as the device moves down and unwound as it moves up disposed about said shaft, means connecting the torsion shaft with said device to rotate the shaft in a direction to wind the spring as the device moves down and for rotation in the opposite direction as the device moves up, a respective end member connected to each end of the torsion spring, torsion spring winding and adjusting means comprising a support structure mounted against movement about or along the axis of said torsion shaft, said winding and adjusting means comprising an output drive shaft coaxial with and rotatable about said axis and self-locking drive means for rotating said drive shaft in different directions about said axis to respectively wind and unwind said torsion spring, end fixing means for said torsion spring means comprising first and second connecting means connecting a respective one of said end members to a respective associated one of said rotatable torsion and drive shafts to fix the corresponding end member against relative movement with respect to the respective rotatable shaft, one of said first and second connecting means comprising securing means for interchangeably fixing the respective end member for the connecting means to the associated shaft for rotation therewith while enabling longitudinal movement of the end member relative to its associated shaft during winding of said spring or fixing the end member against movement longitudinally of its corresponding shaft and for rotation therewith, said securing means including interfitting connecting elements on the end member and shaft to which the securing means connects the end member with said interfitting connecting elements being constructed and arranged to allow relative longitudinal movement along the shaft while precluding relative rotational movement of the shaft and end member, said interfitting elements comprising a set screw and a receiving opening therefor in respective ones of the end member and rotatable shaft.

20. A torsion spring counterbalancing mechanism for a garage door or other device movable between up and down positions as defined in claim 19 in which said set screw is threaded into the end member and has an end portion extending into the receiving opening in the respective shaft with the threads and end portion of the set screw being so constructed and arranged that the set screw cannot be threaded out of said receiving opening.

21. A torsion spring counterbalancing mechanism for a garage door or other device to be moved up and down comprising a torsion shaft rotatable about an axis, torsion spring means comprising a torsion spring to be wound as the device moves down and unwound as it moves up disposed about said shaft, means connecting the torsion shaft with said device to rotate the shaft in a direction to wind the spring as the device moves down and for rotation in the opposite direction as the device moves up, a respective end member connected to each end of the torsion spring, torsion spring winding and adjusting means comprising a support structure mounted against movement about or along the axis of said torsion shaft, said winding and adjusting means comprising an output drive shaft coaxial with and rotatable about said axis and self-locking drive means for rotating said drive shaft in different directions about said axis to respectively wind and unwind said torsion spring, end fixing means for said torsion spring means comprising first and second connecting means connecting a respective one of said end members to a respective associated one of said rotatable torsion and drive shafts to fix the corresponding end member against relative movement with respect to the respective rotatable shaft, one of said first and second connecting means comprising securing means for interchangeably fixing the respective end member for the connecting means to the associated shaft for rotation therewith while enabling longitudinal movement of the end member relative to its associated shaft during winding of said spring or fixing the end member against movement longitudinally of its corresponding shaft and for rotation therewith, said securing means including interfitting connecting elements on the end member and shaft to which the securing means connects the end member with said interfitting connecting elements being constructed and arranged to allow relative longitudinal movement along the shaft while precluding relative rotational movement of the shaft and end member, said interfitting elements comprising a set screw and a receiving opening therefor in respective ones of the end member and shaft connected by the receiving means.

22. A torsion spring counterbalancing mechanism for a garage door or other device movable between up and down positions as defined in claim 19, 20, or 21 wherein said second connecting means connects the corresponding end member to said drive shaft and comprises said securing means.

23. A torsion spring counterbalancing mechanism for a garage door or other device to be moved up and down comprising a torsion shaft rotatable about an axis, torsion spring means comprising a torsion spring to be wound as the device moves down and unwound as it moves up disposed about said shaft, means connecting the torsion shaft with said device to rotate the shaft in a direction to wind the spring as the device moves down and for rotation in the opposite direction as the device moves up, a respective end member connected to each end of the torsion spring, torsion spring winding and adjusting means comprising a support structure mounted against movement about or along the axis of said torsion shaft, said winding and adjusting means comprising an output drive shaft coaxial with and rotatable about said axis and self-locking drive means for rotating said drive shaft in different directions about said axis to respectively wind and unwind said torsion spring, end fixing means for said torsion spring means comprising first and second connecting means connecting a respective one of said end members to a respective associated one of said rotatable torsion and drive shafts to fix the corresponding end member against relative movement with respect to the respective rotatable shaft, one of said first and second connecting means comprising securing means for interchangeably fixing the respective end member for the connecting means to the associated shaft for rotation therewith while enabling longitudinal movement of the end member relative to its associated shaft during winding of said spring or fixing the end member against movement longitudinally of its corresponding shaft and for rotation therewith, said securing means including interfitting connecting elements on the end member and shaft to which the securing means connects the end member with said interfitting connecting elements being constructed and arranged to allow relative longitudinal movement along the shaft while precluding relative rotational movement of the shaft and end member, said interfitting elements comprising a set screw and a receiving opening therefor in respective ones of the end member and rotatable shaft, said torsion spring means comprises said first said spring as a first spring and a second torsion spring disposed coaxially about said torsion shaft and said winding and adjusting means being disposed between said springs, end members each connected to respective one of the opposite ends of said second spring, said end fixing means further comprising third and fourth connecting means each connecting a respective one of said end members for said second spring to a respective one of said rotatable torsion and drive shafts to fix the corresponding end member against relative movement with respect to the respective rotatable shaft, one of said third and fourth connecting means comprising securing means for interchangeably fixing the end member to its respective shaft for rotation therewith while enabling longitudinal movement of the end member relative to its respective shaft during the winding of said spring of fixing the end member against movement longitudinally of its corresponding shaft and for rotation therewith, each of said securing means including interfitting connecting elements on the end member and the shaft to which the securing means connects the end member with said interfitting connecting elements being constructed and arranged to allow relative longitudinal movement along the shaft while precluding relative rotational movement of the shaft and end member, said interfitting elements comprising a set screw and a receiving opening therefor in respective ones of the end member and rotatable shaft.

24. A torsion spring counterbalancing mechanism for a garage door or other device movable between up and down positions as defined in claim 23 in which each said set screw is threaded into the end member and has an end portion extending into the receiving opening in the respective shaft with the threads and end portion being so constructed and arranged that the set screw cannot be threaded out of said receiving opening.

25. A torsion spring counterbalancing mechanism for a garage door or other device to be moved up and down comprising a torsion shaft rotatable about an axis, torsion spring means comprising a torsion spring to be wound as the device moves down and unwound as it moves up disposed about said shaft, means connecting the torsion shaft with said device to rotate the shaft in a direction to wind the spring as the device moves down and for rotation in the opposite direction as the device moves up, a respective end member connected to each end of the torsion spring, torsion spring winding and adjusting means comprising a support structure mounted against movement about or along the axis of said torsion shaft, said winding and adjusting means secured to said support means, said winding and adjusting means comprising an output drive shaft coaxial with and rotatable about said axis and self-locking drive means for rotating said drive shaft in different directions about said axis to respectively wind and unwind said torsion spring, end fixing means for said torsion spring means comprising first and second connecting means connecting a respective one of said end members to a respective associated one of said rotatable torsion and drive shafts to fix the corresponding end member against relative movement with respect to the respective rotatable shaft, one of said first and second connecting means comprising securing means for interchangeably fixing the respective end member for the connecting means to the associated shaft for rotation therewith while enabling longitudinal movement of the end member relative to its associated shaft during winding of said spring or fixing the end member against movement longitudinally of its corresponding shaft and for rotation therewith, said securing means including interfitting connecting elements on the end member and shaft to which the securing means connects the end member with said interfitting connecting elements being constructed and arranged to allow relative longitudinal movement along the shaft while precluding relative rotational movement of the shaft and end member, said interfitting elements comprising a set screw and a receiving opening therefor in respective ones of the end member and rotatable shaft, said torsion spring means comprising said first said spring as a first spring and a second torsion spring disposed coaxially about said torsion shaft and said winding and adjusting means being disposed between said springs, end members each connected to respective one of the opposite ends of said second spring, said end fixing means further comprising third and fourth connecting means each connecting a respective one of said end members for said second spring to a respective one of said rotatable torsion and drive shafts to fix the corresponding end member against relative movement with respect to the respective rotatable shaft, one of said third and fourth connecting means comprising securing means for interchangeably fixing the end member to its respective shaft for rotation therewith while enabling longitudinal movement of the end member relative to its respective shaft during the winding of said spring or fixing the end member against movement longitudinally of its corresponding shaft and for rotation therewith, said drive means disposed in a fixed position along the axis to the torsion shaft and comprises a worm wheel rotatable about said torsion shaft for rotating said drive shaft, and a worm drive gear for said worm wheel for selectively rotating or adjusting the worm wheel, said worm drive gear and worm wheel being self-locking to preclude rotation of the drive shaft and worm wheel by the springs connected thereto, each of said securing means including interfitting connecting elements on the end member and the shaft to which the securing means connects the end member with said interfitting connecting elements of each securing means being so constructed and arranged to selectively allow relative longitudinal movement along the shaft while precluding relative rotational movement of the shaft and end member, said interfitting elements of each securing means comprising a set screw and a receiving opening therefor in respective ones of the end member and shaft connected by the securing means.

26. A torsion spring counterbalancing mechanism as defined in claim 23, 24, or 25 wherein each connecting means connecting a spring end member to said drive shaft comprises said securing means and said interfitting elements.

27. In a garage door counterbalancing mechanism, counterbalancing means including torsion spring means comprising a torsion spring, a spring end member fixed to said end of said spring, a second member to which the torsion spring is fixedly connected during operation of said counterbalancing operation, connecting means for fixing said end member to said second member comprising securing means including interfitting elements on said end member and said second member cooperating to fix said end member to said second member to secure them against relative movement, said connecting means selectably setable when setting the torsion of the torsion spring to allow relative longitudinal movement during spring winding between said end member and said second member longitudinally of the axis of said torsion spring while maintaining a mechanical connection therebetween for preventing relative rotation of said end member and said second member and secure said end and second member to set the torsion of the torsion spring, said second member comprising a shaft and said end member is disposed about said shaft, said interfitting elements comprising an elongated receiving opening on one of shaft and end member and a cooperating element received in said elongated opening on the other of said shaft and end member.

28. In a garage door counterbalancing mechanism as defined in claim 27 wherein said elongated receiving opening is on said shaft and said element is on said end member.

29. In a garage door counterbalancing mechanism as defined in claim 28 in which said shaft is a rotatable drive shaft for rotating said spring end about its axis and has drive means associated therewith to rotate said drive shaft.

30. In a garage door counterbalancing mechanism as defined in claim 27 in which said second member is a rotatable drive shaft and drive means is associated therewith for driving said shaft and comprises a worm wheel connected to said drive shaft and a worm gear for driving said worm wheel to rotate said drive shaft with said worm gear and worm wheel being self-locking against being driven from said drive shaft as to lock said spring end in a fixed position.

31. In a garage door counterbalancing mechanism as defined in claim 13, 29 or 14 in which said drive means comprises a worm wheel connected to said drive shaft and a worm gear for driving said worm wheel to rotate said drive shaft with said worm gear and worm wheel being self-locking against being driven from said drive shaft and in which said torsion spring means comprises a second torsion spring disposed coaxially with the first said spring with said drive means being disposed between said torsion springs adjacent to an end of said second spring, a second spring end member fixed to said end of said second spring, an output drive shaft portion from said drive means to be connected to said second spring end member for rotating the end member to wind or unwind said spring, second securing means connecting said second spring end member to said shaft portion for rotation therewith and simultaneous rotation with said drive shaft and selectably setable to enable said second spring end member to move longitudinally of said shaft portion on the rotation thereof during the winding of said spring.

32. In a garage door counterbalancing mechanism as defined in claim 29 in which said drive means comprises a worm wheel connected to said drive shaft and a worm gear for driving said worm wheel to rotate said drive shaft with said worm gear and worm wheel being self-locking against being driven from said drive shaft as to lock said spring end in a fixed position.

33. A winding and unwinding mechanism for a torsion spring counterbalancing device for a garage door or other device movable between up and down positions in which a torsion spring to be wound and unwound is disposed about a torsion shaft, said mechanism comprising a support structure to be mounted in a stationary position along the torsion shaft, a hollow drive shaft to be disposed about the torsion shaft journaled in a fixed position in said support for rotation about the axis of the drive shaft and adapted to have a spring end member connected thereto for rotation therewith in a fixed position thereon or while longitudinally movable thereon while fixed for rotation therewith selectively, a worm wheel coaxially disposed about said drive shaft, connecting means for connecting said worm wheel and said shaft to effect rotation of said spring end member about the spring axis upon rotation of said worm wheel, a worm drive journaled in a fixed position in said support structure for driving said worm wheel, said drive shaft extending axially outwardly from said wheel to be fixedly connected to an end member of a torsion spring, said connecting means being setable to a first condition in which a spring end member and said shaft are fixed for rotation with said gear wheel and against movement along said drive shaft axis and to a second condition in which the end member on rotation by said drive shaft moves longitudinally of said drive shaft axis, the connecting means comprising cooperating interfitting elements for effecting the rotation of the spring end member and allowing said longitudinal movement on rotation of said drive shaft and spring end member.

34. A winding and unwinding mechanism as defined in claim 33 in combination with a torsion shaft for connection with a door to counterbalance the door and to rotate in opposite directions to unwind and wind the spring as the door moves in an up direction and in a down direction respectively, a torsion spring disposed about said shaft on one side of said support structure, said spring having end members on the opposite ends thereof, said connecting means connecting one of said end members to said drive shaft, and means connecting the other of said end members to said torsion shaft.

35. A winding and unwinding mechanism as defined in claim 34 in which said mechanism comprises a shaft portion journaled in said support and disposed about said torsion shaft on the side of said support structure way from the first said drive shaft, said shaft portion extending axially outwardly from said worm wheel in a direction away from the first said spring, a second torsion spring disposed about said torsion shaft adjacent the outer end of said shaft portion, said torsion spring having second end members united with respective ones of the opposite ends of said second spring, said connecting means comprising second connecting means connecting worm wheel to rotate said shaft portion to one of said second end members for winding and unwinding the second spring, said second connecting means being setable to a first condition in which said one second spring end member and said shaft portion are fixed for rotation with said gear wheel and against movement along said drive shaft axis and to a second condition in which said one second end member on rotation by said drive shaft moves longitudinally of said drive shaft axis, said second connecting means comprising cooperating interfitting elements for effecting the rotation of the spring end member and allowing said longitudinal movement on rotation of said drive shaft and spring end member, and means for fixing the other of said second end members to said torsion shaft.

36. A winding and unwinding mechanism as defined in claim 33 wherein said mechanism has a shaft portion journaled in said support coaxially with said gear wheel and disposed on the side of said support structure away from the first said drive shaft for connecting said gear wheel to rotate a spring end member of a second torsion spring, disposed coaxially with said gear wheel, said connecting means comprising second connecting means connecting said worm wheel to rotate said shaft portion through said shaft portion and the end member of said second spring for winding and unwinding the second spring, said second connecting means being setable to a first condition in which the second spring end member and said shaft portion are fixed for rotation with said gear wheel and against movement along the axis of said shaft portion and to a second condition in which rotation of the shaft portion by said gear wheel effects rotation of the spring end member connected to said shaft portion and allows the spring end member to move longitudinally of said drive shaft axis, said second connecting means comprising cooperating interfitting means for effecting the rotation of the spring end member and allowing the said longitudinal movement of the spring end member on rotation of said shaft portion and spring end member by said worm wheel.

* * * * *